US006544148B1

(12) United States Patent
Loew

(10) Patent No.: US 6,544,148 B1
(45) Date of Patent: Apr. 8, 2003

(54) JUMP ROPE WITH WEIGHTED HANDLES AND ROPE

(76) Inventor: David P Loew, 931 W. Gunnisou St., Chicago, IL (US) 60640

( * ) Notice: Subject to any disclaimer, the term of this patent is extended or adjusted under 35 U.S.C. 154(b) by 0 days.

(21) Appl. No.: 09/455,382

(22) Filed: Dec. 6, 1999

(51) Int. Cl.[7] ..... A63B 5/20
(52) U.S. Cl. ..... 482/82
(58) Field of Search ..... 482/81, 82, 74, 482/121, 125, 126, 907, 93; 472/135

(56) References Cited

U.S. PATENT DOCUMENTS 2,719,038 A * 9/1955 Massa
4,201,382 A * 5/1980 Wilson ..... 482/82
4,281,832 A * 8/1981 Quinby, Jr. ..... 482/82
4,647,037 A * 3/1987 Donohue ..... 482/82
4,778,173 A * 10/1988 Joutras ..... 482/82

* cited by examiner

*Primary Examiner*—Stephen R. Crow
(74) *Attorney, Agent, or Firm*—Martin Faier; Faier & Faier, P.C.

(57) ABSTRACT

A weighted jump rope for use by a person in an exercise routine which comprises a length of swingable rope, a pair of spaced apart handles, one handle on each opposed end of the length of swingable rope, each of the handles having a grip adapted for use by a person to swing the rope, and one or more weight elements removably secured on each handle, and a movable counterweight secured on the length of rope spaced apart from the handles for varying the swing of the rope. The invention includes a novel ball lock adapted to removable secure the weights on the handle and a snaphook assembly device for quickly attaching and detaching the rope from the handles when replacing or shortening the rope.

19 Claims, 5 Drawing Sheets

JUMP ROPE WITH WEIGHTED HANDLES AND ROPE

BACKGROUND OF THE INVENTION

Weighted jump ropes are well-known in the prior art, for example:

Massa U.S. Pat. No. 2,719,038, granted Sep. 27, 1955, for a WEIGHTED JUMP ROPE;

Winston U.S. Pat. No. 4,157,827, granted Jun. 12, 1979, for a HANDGRIP FOR JUMP ROPE AND SIMILARLY GRIPPED EXERCISE DEVICES;

Waitz U.S. Pat. No. 4,593,903, granted Jun. 10, 1986, for a VARIABLE WEIGHT EXERCISING DEVICE;

Donohue U.S. Pat. No. 4,647,037, granted Mar. 3, 1987, for a WEIGHTED JUMP ROPE HANDLE;

Grant U.S. Pat. No. 4,787,624, granted Nov. 29, 1988, for a JUMP ROPE ATTACHMENT FOR HAND-WEIGHTS;

Douglas U.S. Pat. No. 4,801,137, granted Jan. 31, 1989, for a VARIABLE WEIGHT HAND HELD EXERCISE APPARATUS; and McNamara U.S. Pat. No. 5,662,561, granted Sep. 2, 1997, for a WEIGHTED HANDLE FOR A JUMP ROPE.

Weighted handles for jump ropes add resistance to the exercise and help develop the muscles of the wrist, forearm, biceps, triceps and chest. The versatility of such devices is substantially improves where the jump rope design permits adding weight to the handle, thus increasing the degree of difficulty of the exercise, creating an effective aerobic and anabolic workout, as disclosed in some of these prior art patents. Additionally, the use of a weighted jump rope provides a full body workout using all of the large muscle groups.

However, all of these prior art ropes have no or cumbersome means for varying and changing the weights applied to the jump rope handle. Some prior art devices have the weight applied to the rope in an ineffective position to give maximum exercise value to the device. None of these prior art devices have a weighted rope remote from the handles and none have means for adjustment of the weight or dynamic shape of the rope during exercise.

SUMMARY OF THE INVENTION

In a weighted jump rope according to the present invention, discs of varying size and weight are stacked individually or as a group between the jump rope handle and the cap and held in place by a novel single action spring loaded passive locking device located in the handle. These weights are arranged on the handle forward of the hand grip, but yet maintaining the center of gravity closer to the hand. The cap encloses the shaft of a ball lock a set of cavities being arranged within the cap to hold the ball lock, and secure the discs in a desired selected position between the handle and the cap. The rope may be secured to the cap or a rotatable clip may be secured to the cap and a connector at the ends of the rope may be secured to the cap. The invention also includes efficient and simple means for connecting the jump rope to the handles, providing easy shortening or changing of the rope.

Preferably, soft, lightweight, repositionable weights, are selectively positioned along the length of jump rope. The weights which may be fabricated from rubber or plastic, and have an aperture therethrough so that they may be threaded over the jump rope. The aperture and rope are cooperatively sized to slidably frictionally engage the rope, so that they will remain in a selected position until manually moved.

The stackable handle weights work in conjunction with the rope counter weights, making it easier to manipulated the jump rope during exercise, enhanced by centrifugal force. These counter weights also permit dynamic rope swing patterns to be selectively accomplished, adjusted and controlled. The speed of the swing may also be affected by adjusting the position of the counter weight on the rope.

The adjustable counter weights may be fabricated from materials which are colored or photo luminous, making it easier for the user to develop acrobatic jump rope use and as a means to display one's performance. Also such a fabrication makes it easier to use the jump rope in a darkened setting, as the swing of the rope may be easily seen and tracked.

The disc weights preferably are stackable and interlocking, providing a stable weighted handle design. The single action novel quick lock and release mechanism for removably securing the discs and varying weight on the handle are not only convenient, but also permit quick timely changeover of weights without losing the rhythm of the workout, thus providing opportunities for combining anabolic and aerobolic benefits to the exercise.

OBJECTS AND ADVANTAGES OF THE INVENTION

It is the object of the present invention to provide a jump rope with weighted handles and rope of the character described.

Another object is to provide a jump rope with novel stackable selectively interchangeable interlocking disc weights which may be quickly releasably secured on a jump rope handle.

Another object is to provide quick action simple and effective mechanism for releasably securing disc weights on a jump rope.

Another object is to provide a spring loaded ball lock and shaft arrangement for release and secure mechanism of disc weights on a jump rope handle.

Another object is to provide a jump rope with weighted handles and rope where the handle weights are arranged forward of the handle grips but close to the center of gravity during use.

Another object is to provide a jump rope having cooperating adjustable weights on its handle and rope length.

Another object is to provide a length of robe for a jump rope with counterweights mounted thereon.

Another object is to provide repositionable counterweights for a length of jump rope.

Another object is to provide repositionable counterweight that adapt to different length rope for different size users.

Another object is to provide colored or photo luminescent counterweights for a length of jump rope.

Another object is to provide novel means for connecting and disconnecting a jump rope to a handle, facilitating easy and quick changing and shortening of the rope.

Another object is to provide a jump rope with weighted handles and rope which is simple, and easy to manufacture and use and efficient in providing exercise for its user.

These and other objects and advantages will become apparent as this description proceeds, taken in conjunction with the accompanying drawings.

DESCRIPTION OF PREFERRED EMBODIMENTS

Figures 1, 2, 3:
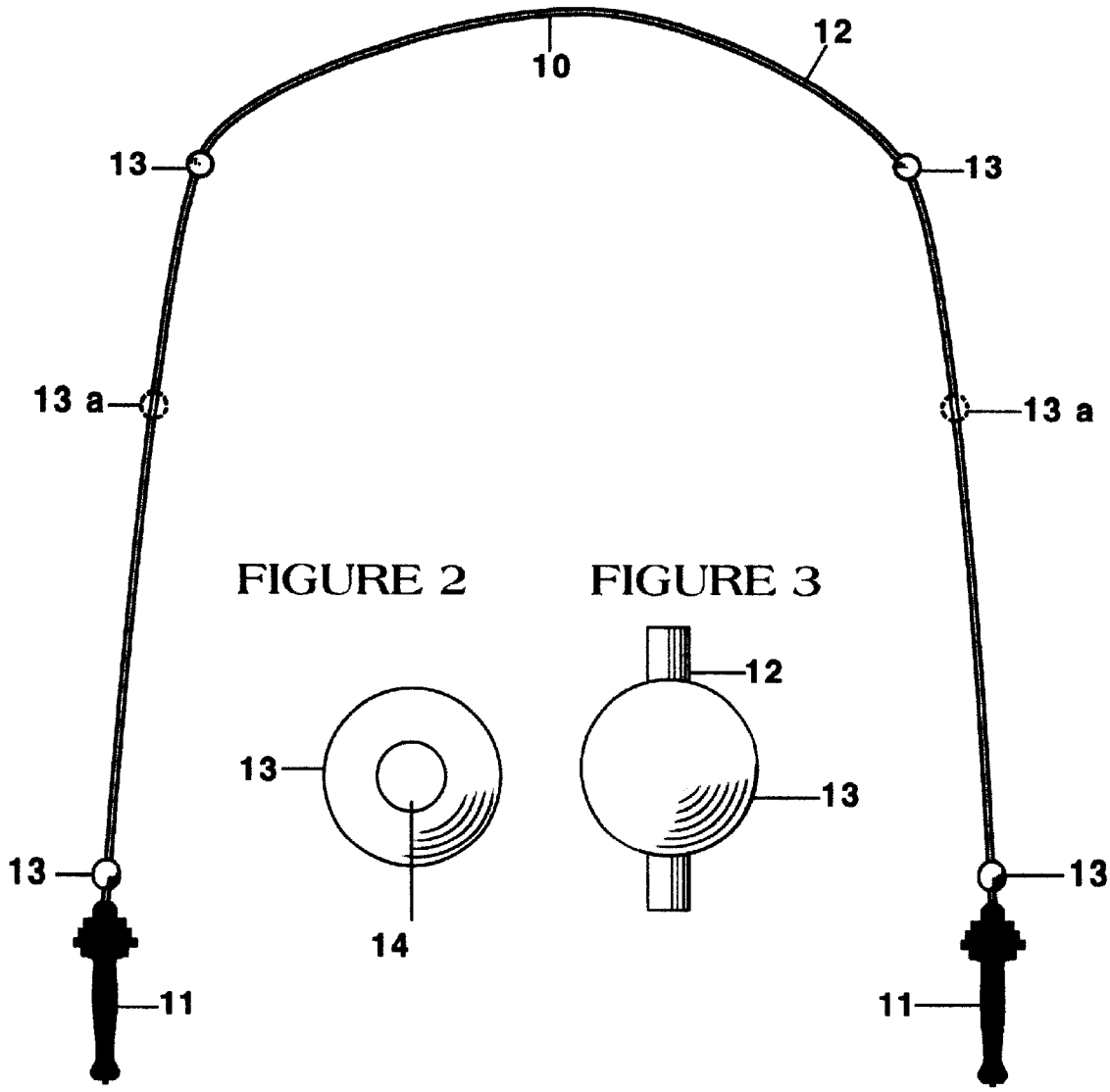
FIG. 1 is a elevational view of a jump rope, showing the novel handles and counterweights, with another set of counterweights show in dotted lines.
FIG. 2 is an enlarged elevational view of a counterweight.
FIG. 3 is a perspective view of the counterweight shown in FIG. 2 taken at a right angle to FIG. 2, threaded over a section of jump rope.

With reference to the accompanying drawings and particularly to FIG. 1, a jump rope 10 has at each end a weighted handle 11, and a length of rope 12 extending therefrom. Positioned along the rope length 12 are a pair of spaced apart counterweights 13, each of which may be equal distant from the weighted handles 11. These counterweights 13 are preferably made of soft, relatively lightweight rubber or plastic and may be selectively positioned and repositioned at any desire points along the rope length 12, for example see the counterweights 13*a* shown in dotted lines in FIG. 1. As shown in FIGS. 2 and 3, these counterweights 13 may be round and have a central aperture 14 which permits them to be moved along the rope length 12, but movably gripping the rope length, so that they may be hand manipulated as desired.

Figure 4:
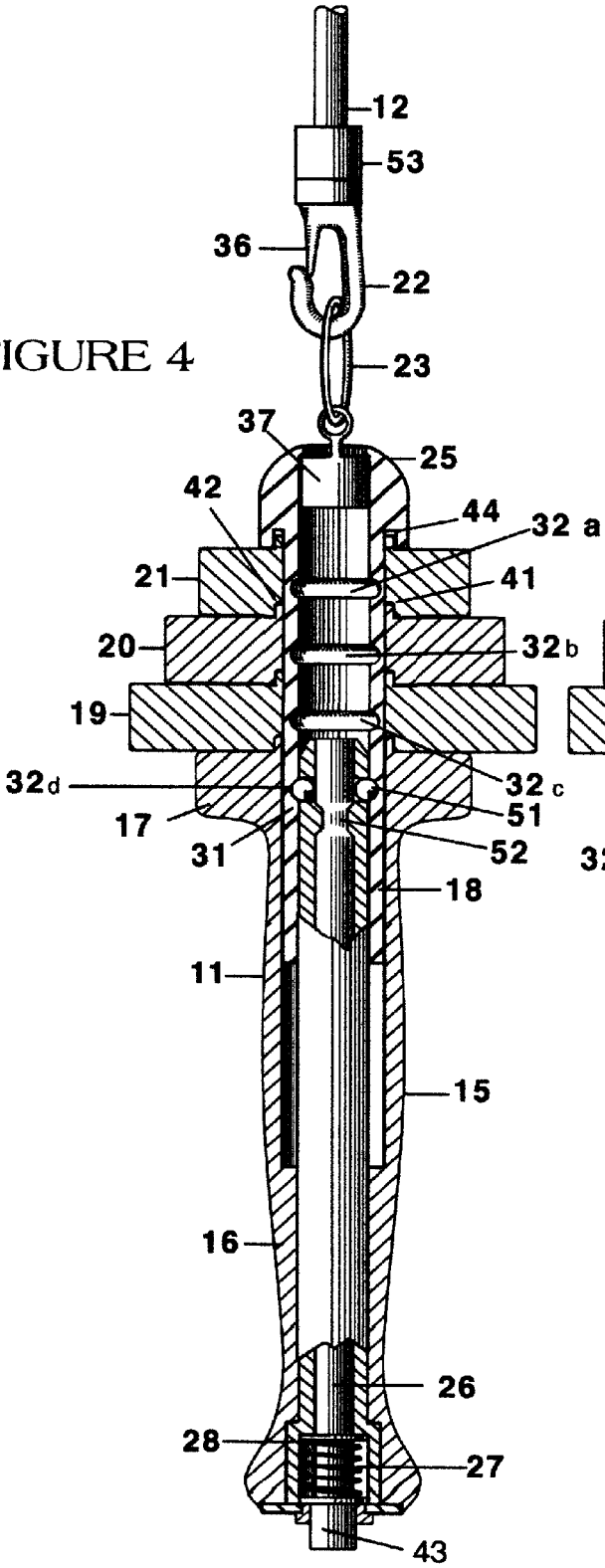
FIG. 4 is an enlarged sectional view of a jump rope handle with the weights locked in position and having clip and connector devices for securing the jump rope on the handle.
Figure 5:
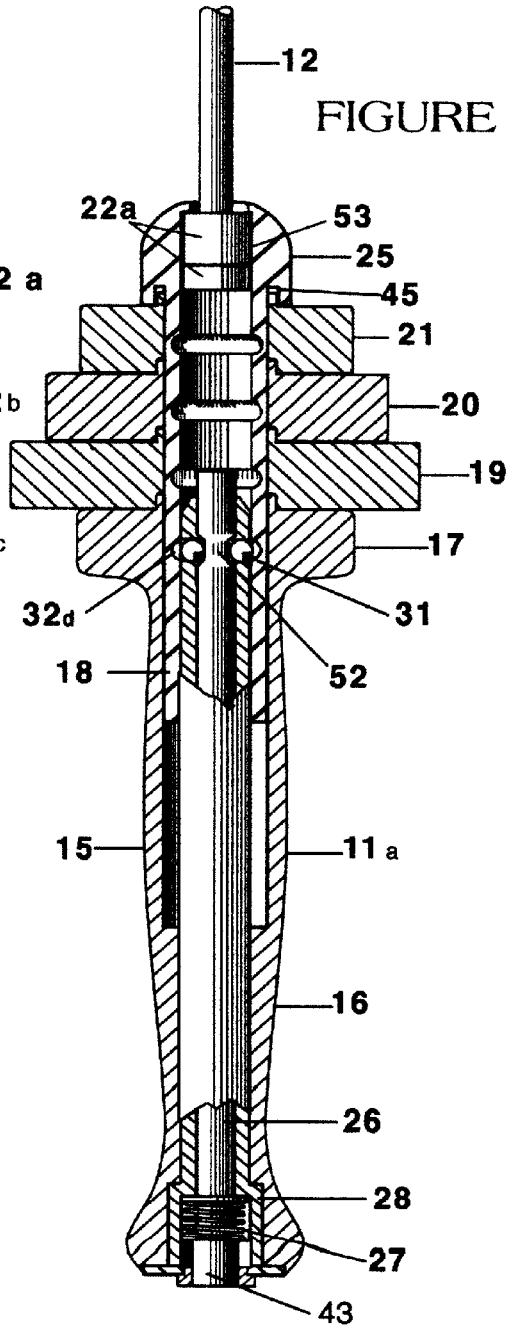
FIG. 5 is a sectional view similar to FIG. 4, except with the jump rope secured directly to the handle and with the weights in released position.

The weighted handles 11 and 11*a*, shown in section in FIGS. 4 and 5, respectively, consists of a handle body 15 with an exterior gripper surface 16. A shoulder 17 is arranged in the handle body 15 and weights 19, 20 and 21 may be nested thereon. In the FIG. 4 embodiment, the end of the jump rope length 12 is connected to the handle 11 through a clip 22 and connector assembly 23 while in the FIG. 5 embodiment, the end of the jump rope 12 is connected to a snap hook 22*a*, all in a manner to be described. A cap 25 of a diameter sufficient to overlie each of the apertures 30 in the disc weights 19–21 and the shoulder 17 of the body 15, secures the disc weights on the handle body 15 in a manner to be described.

The lock and release mechanism for removably securing one or more of the nested weights 19–21 comprises a rod or spindle 26 which reciprocates within a shaft or casing 18, and has a normally extended compression spring 27 enclosed in a spring cage 28, through which the rod 26 moves, and is shouts in this position in FIG. 4. At the end 35 of the rod 26 remote from the rope 12 near the end of handle 11, there is a button 43 which caused the rod to reciprocate. The rod or spindle 26 has a groove 52 reducing its diameter which is adapted to receive a cooperating ball lock 31 seated m this groove when the rod is reciprocated toward the disc weights 19–21, as shown in FIG. 5, where the spring 27 is compressed. This shaft 18 also has a series of spaced apart grooves 32(*a*)–32(*d*), similar in shape to groove 29, but disposed oppositely to said groove, which are adapted to receive the ball lock 31 in a selected position, permitting the removal of the cap 25 and one or more of the nested weight 19–21 from the handle 11 or 11*a*.

As discussed above, in the FIG. 4 embodiment, the end of the jump rope length 12 is conuected to the handles 11 through a clip or snaphook assembly 22 and connector 23 (which will be more fully discussed hereafter with regard to FIGS. 11 and 12) while in the FIG. 5 embodiment, the end of the jump rope 12 is connected to a converted snap hook 22*a* all in a manner tobe described. In the FIG. 4 embodiment, the clip 22 on junmp rope 12 can be installed on or removed from the weighted handle 11 is freed from the rope length by merely depressing the clip tongue 36 and withdrawing the connector 23 from the clip. This connector 23 is also connected to a plug 37 freely rotatable but secured in the handle 11. In the FIG. 5 embodiment, the converted snap hook 22*a* substitutes for the plug and merely hold the end of the rope length 12 freely rotatable and secured in the handle 11*a*.

Figure 6:
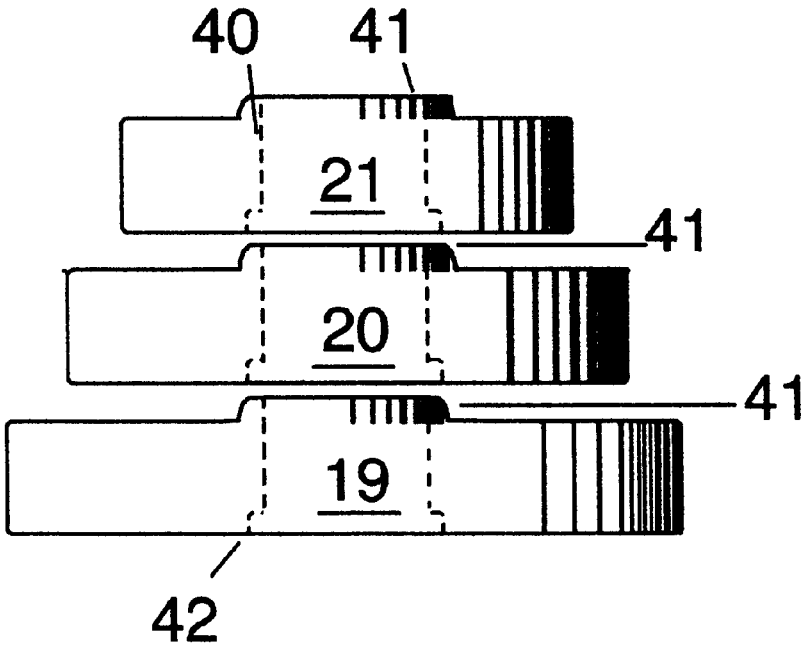
FIG. 6 is an enlarged isometric view of the handle weights showing the nesting arrangement.
Figure 7:
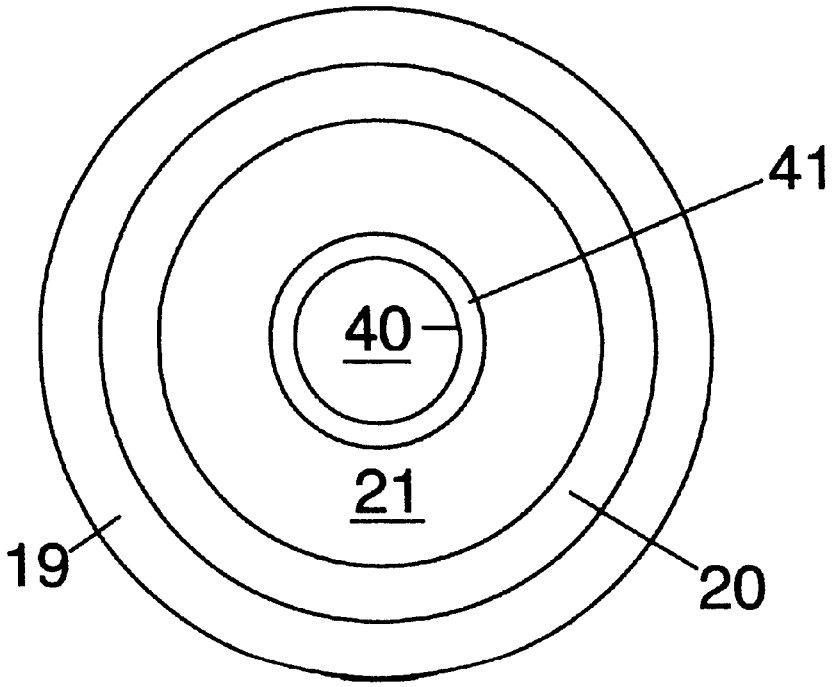
FIG. 7 is a top elevational view of the nested weights shown in FIG. 6.

The disc weights, shown in FIGS. 6 and 7, have a central aperture 40, which is surrounded by an upstanding boss 41 on each of the disc weights 19–21. As shown in phantom lines in FIG. 6, the bottom of the central aperture 40 on each of the weighted discs 19–21 has an enlargement 42 to accommodate the boss 41, thus stacking the disc weights together. A rubber washer 44 which fits beneath the cap 25 under the relief 45 corresponding to the boss 41 and enlargement 42 on the weights, thus keeping the weights 19, 20 and/or 21 tight, as shown in FIGS. 4 and 5.

Each of disc weights 19–21 is of substantially sinilar thickness, but of consecutively smaller diameter, and the weight of each disc is detennined by its size. The weight of a disc may also be varied according to other means, for example, thickness or density, which may cause the ball lock system to vary from the relative sizes shown.

Figure 9:
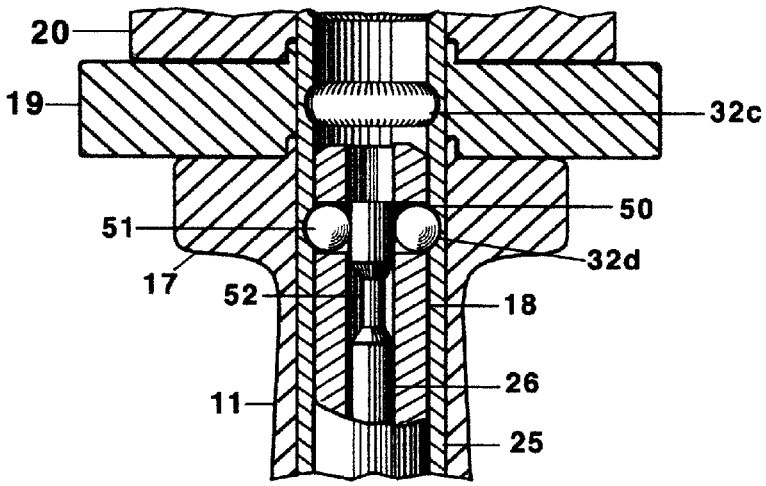
FIGS. 9 and 10 are enlarged sectional views of the jump rope handles using the modified ball lock, in position where the weights are locked on the handle and unlocked during insertion of the ball lock, respectively.
Figure 8:
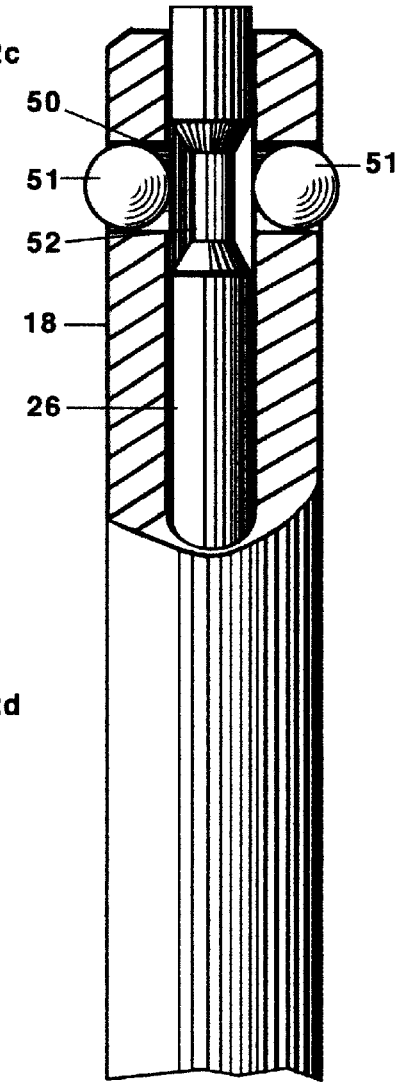
FIG. 8 is an enlarged elevational view of the ball lock casing, partially in section for a modified form of the ball lock.
Figure 10:
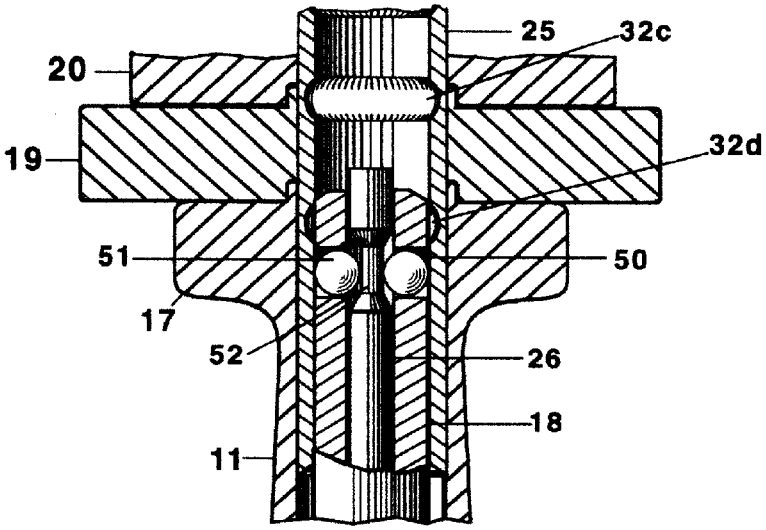

With reference to FIGS. 8–10, the ball lock and release mechanism has a casing 18 within which a spindle 26 reciprocates. As shown in FIG. 8, the casing 18 has a lateral aperture 50 across its diameter, within which ball bearings 51 are nested in opposed relation, which may be accomplished by magnetizing either the spindle 26 or bearing 51 to attract the bearings. When the cap 25 is secured in the jump rope handle, the position of the spindle 26 relative to the casing 18 is arranged so that the bearings 51 will be moved outwardly by the larger diameter of the spindle when in locked position, as depicted in FIG. 9. The position of the spindle 26 relative to the casing 18 is arranged so that the bearings 51 will be moved inwardly by the smaller diameter of the groove 52 in the spindle 26 when in unlocked position, depicted in FIG. 10. Thus when the spindle 26 is reciprocated un the casing 18, the ball bearings 51 will enter the spindle groove 52 when unlocked and be moved into locking position with the ball bearings forced into one of the locking grooves 32(*a*)–32(*d*) of the cap 25.

Figure 11:
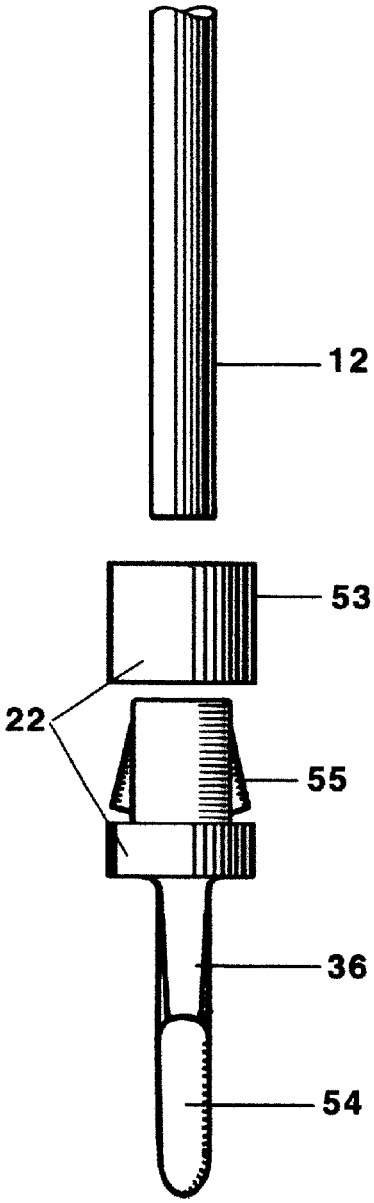
FIG. 11 is an isometric view showing rope and snaphook assembly for adjusting the length or changing the rope.
Figure 12:
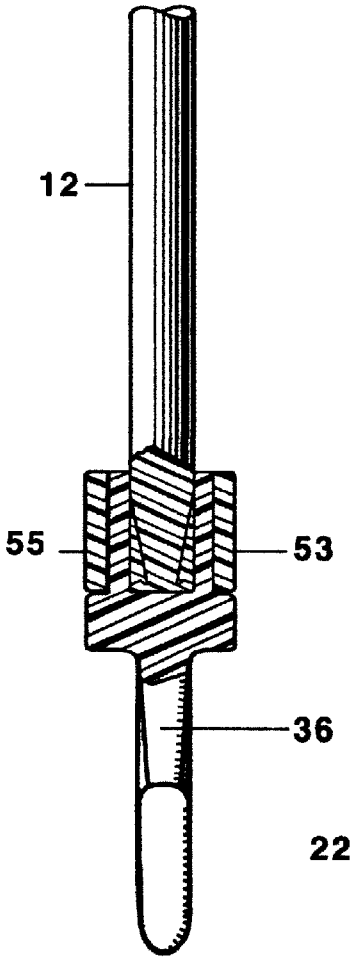
FIG. 12 is an elevation view of the rope and snaphook assembly in assembled condition, partially in section.

As shown in FIGS. 11 and 12, the rope may be quickly shortened or changed using the snaphook assembly 22 and 22*a*, wherein the rope 12 is threaded into the snaphook collar 53 and press fit over the snaphook 54, causing the wedged detent 55 to bear against and lock the rope into position. Removal of the rope 12 from the snaphook assembly 22 and 22*a* is accomplished by reversing the installation procedure, namely depressing the wedged detent 55 to slide out the snaphook collar 53 from the snaphook, thus freeing the rope for changeover or shortening.

Figure 13:
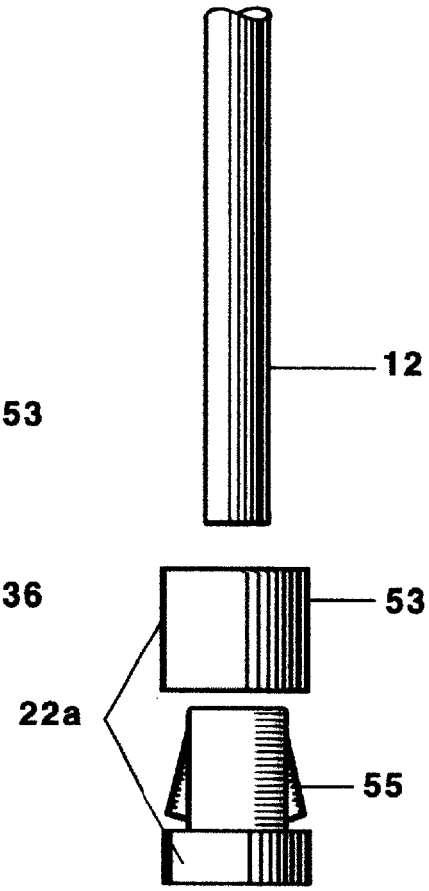
FIG. 13 is an isometric view similar to FIG. 11, except without the connecting hook.

In the FIG. 13 embodiment, the snaphook 54 is omitted, and the modified snaphook assembly 22*a* is used for securing the rope in the handle, as shown in FIG. 5. This modified snaphook assembly 22*a* in section is substantially identical to the snaphook 22 shown in FIG. 12 except the connector hook 54 and tongue 36 have been cut away and eliminated, and the rope 12 is secured in the collar 53 by means of the detent 55. Removal of the collar 53 from the detent 55 is easily accomplished by turning the detent relative to the collar, so that the collar may be separated from the detent and the rope removed from the collar.

In use, the arrangement of the weighted discs 19–21 places the weight near the center of gravity but forward of the grips 16, thus making the workout more strenuous. The quick release arrangement of the ball lock system disclosed allows the user to quickly change weights during workout, so that the rhythm of the exercise is not lost. The counterweights 13 on the length of jump rope 12 not only provide counterweight against the movement of the jump rope during a workout, but also selectively define the dynamic swing of the jump rope, to accommodate ropes of different sizes or persons of different height, posture and exercise potential.

While preferred embodiments of the invention have been shouts and described, it is not intended that the scope or spirit of the invention should be limited to the exact structure of the disclosure, except as limited by the appended claims, as many changes can be made in specific elements of the structure without departing from the spirit and intended scope of the invention.

The following improvements are claimed:

What is claimed is:

1. A weighted jump rope for use by a person in an exercise routine, said weighted jump rope comprising:

a length of swingable rope, a pair of spaced apart handles, one on each opposed end of said length of rope, each of said handles comprising a grip adapted for said person to swing said rope, and a body having a shaft adapted for supporting one or more of weights on said handle and a rod extending through said body and said one or more weights, said rod having releasably securing means for holding said one or more of said weights on said handle, said releasably securing means comprising a ball lock between said shaft and said rod, and movable means on said rod for selectively moving said ball lock into weight release and securing positions.

2. The weighted jump rope recited in claim 1, wherein a spring in said body normally urges said ball lock and movable means into weight securing position.

3. The weighted jump rope recited in claim 2, wherein a cap holds said one or more said weight elements against said body.

4. A weighted jump rope for use by a person in an exercise routine, said weighted jump rope comprising:

a length of swingable rope, a pair of spaced apart handles, one on each opposed end of said length of rope, each of said handles comprising a grip adapted for said person to swing said rope, and a snaphook assembly for securing said length of rope to each of said handles, said snaphook assembly defining rope securing means and comprising;

rope connector means secured at one end of each of said handles, hook means removably secured to said rope connector means, a shaft on one end of said hook means, a collar adapted for removably secured engagement on said shaft, said collar having means for receiving an end of said rope and holding said rope therein when said collar is secured on said shaft, wherein said rope securing means has a movable tongue adapted to receive and retain said rope connector means therein when in normal position.

5. The weighted jump rope recited in claim 4, wherein said rope securing means movable tongue may be selectively manipulated to open said rope securing means for release of said rope connector means.

6. The weighted jump rope recited in claim 4, wherein said rope connector means is rotatable in said handle.

7. The weighted jump rope recited in claim 4, wherein rope securing means has a shaft which has a detent adapted to removably engages said collar when said collar is pressed on said shaft and which is adapted for releasing said collar from said shafts upon manipulation of said detent.

8. A weighted jump rope for use by a person in an exercise routine, said weighted jump rope comprising:

a length of swingable rope, a pair of spaced apart handles, one on each opposed end of said length of rope, each of said handles comprising;

a grip adapted for said person to swing said rope, one or more weight elements being secured to each of said handles, and means for removably securing said one or more weight elements on said handles, each of said handles having a body for supporting said one or more weight elements on said handle and shaft and lock means for releasably securing said one or more weight elements on said body, at least one or more of said weight elements having a central aperture which is laid over said body, and a counterweight secured on said length of rope spaced apart from said handles.

9. The weighted jump rope recited in claim 8, wherein each of said one or more weight elements has a boss surrounding said central aperture.

10. The weighted jump rope recited in claim 9, wherein each of said one or more weight elements has a groove corresponding to said boss on another of said one or more weight elements to nest the groove of said one weight element on the boss of said another weight element.

11. The weighted jump rope recited in claim 8, wherein each of said weight elements is of a different weight than another of said weights.

12. The weighted jump rope recited in claim 8, wherein each of said weight elements comprises a disc which is of the same thickness, but of different diameter than said other of said weight elements.

13. The weighted jump rope recited in claim 8, wherein said one or more weight elements are oriented on each of said handle in a direction toward said rope and remote from said handles.

14. The weighted jump rope recited in claim 8, wherein said counterweights are spaced apart from said handles an equal distant to define the swing of said rope.

15. The weighted jump rope recited in claim 8, wherein said length of rope is connected to each of said handles by means of a clip and connector assembly.

16. The weighted jump rope recited in claim 8, wherein said length of rope is freely rotatably connected to each of said handles.

17. The weighted jump rope recited in claim 16, wherein said counterweight means comprises at least two counterweights.

18. The weighted jump rope recited in claim 8, wherein each of said counterweights has a central aperture and said length of rope is threaded through said aperture.

19. The weighted jump rope recited in claim 8, wherein said counterweight comprises a body of rubberlike relatively soft material.

* * * * *